US006003940A

United States Patent [19]

Jackson

[11] Patent Number: 6,003,940

[45] Date of Patent: Dec. 21, 1999

[54] ARM CHAIR WITH MASSAGING WRIST SUPPORTS

[76] Inventor: Gwendolyn Jackson, 37 Williams St., Roxbury, Mass. 02119

[21] Appl. No.: 09/220,953

[22] Filed: Dec. 24, 1998

[51] Int. Cl.[6] ..... A47C 7/54

[52] U.S. Cl. ..... 297/217.3; 297/411.2; 297/411.36

[58] Field of Search ..... 297/217.3, 411.2, 297/411.29, 411.36; 248/118, 118.1, 918

[56] References Cited

U.S. PATENT DOCUMENTS

| | | | |
|---|---|---|---|
| 540,699 | 6/1895 | Smith | 297/411.32 |
| 5,316,373 | 5/1994 | Markel | 297/411.32 |
| 5,335,888 | 8/1994 | Thomsen | 248/118.12 |
| 5,374,102 | 12/1994 | Archambault et al. | 297/411.36 X |
| 5,752,683 | 5/1998 | Novis et al. | 248/118 |
| 5,851,054 | 12/1998 | Bergsten et al. | 297/411.36 X |
| 5,865,404 | 2/1999 | Hesley | 248/918 X |
| 5,868,687 | 2/1999 | Tedeseo | 297/188.01 X |

FOREIGN PATENT DOCUMENTS

| | | | |
|---|---|---|---|
| 794635 | 5/1958 | United Kingdom | 297/391 |

*Primary Examiner*—Peter R. Brown

[57] ABSTRACT

A arm chair with massaging wrist supports for supporting and massaging a user's wrists. The arm chair with massaging wrist supports includes a seat with a support structure for supporting the seat above a surface and a backrest coupled to the seat. A pair of armrests are coupled to opposite sides of the backrest. The armrests each have a wrist support upwardly extending from an upper face of the respective armrest. The wrist supports each have a lower base portion and a spaced apart pair of side portions upwardly extending from the base portion of the respective wrist support.

17 Claims, 2 Drawing Sheets

ARM CHAIR WITH MASSAGING WRIST SUPPORTS

BACKGROUND OF THE INVENTION

1. Field of the Invention

The present invention relates to arm chairs and more particularly pertains to a new arm chair with massaging wrist supports for supporting and massaging a user's wrists.

2. Description of the Prior Art

The use of arm chairs is known in the prior art. More specifically, arm chairs heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,884,846 by Tobler; U.S. Pat. No. 3,397,912 by Bush; U.S. Pat. No. 5,009,467 by McCoy; U.S. Pat. No. Des. 252,781 by Ball; U.S. Patent No. 5,536,070 by Lemmen; and U.S. Pat. No. 5,439,267 by Peterson et al.

While these devices fulfill their respective, particular objectives and requirements, the aforementioned patents do not disclose a new arm chair with massaging wrist supports. The inventive device includes a seat with a support structure for supporting the seat above a surface and a backrest coupled to the seat. A pair of armrests are coupled to opposite sides of the backrest. The armrests each have a wrist support upwardly extending from an upper face of the respective armrest. The wrist supports each have a lower base portion and a spaced apart pair of side portions upwardly extending from the base portion of the respective wrist support.

In these respects, the arm chair with massaging wrist supports according to the present invention substantially departs from the conventional concepts and designs of the prior art, and in so doing provides an apparatus primarily developed for the purpose of supporting and massaging a user's wrists.

SUMMARY OF THE INVENTION

In view of the foregoing disadvantages inherent in the known types of arm chairs now present in the prior art, the present invention provides a new arm chair with massaging wrist supports construction wherein the same can be utilized for supporting and massaging a user's wrists.

The general purpose of the present invention, which will be described subsequently in greater detail, is to provide a new arm chair with massaging wrist supports apparatus and method which has many of the advantages of the arm chairs mentioned heretofore and many novel features that result in a new arm chair with massaging wrist supports which is not anticipated, rendered obvious, suggested, or even implied by any of the prior art arm chairs, either alone or in any combination thereof.

To attain this, the present invention generally comprises a seat with a support structure for supporting the seat above a surface and a backrest coupled to the seat. A pair of armrests are coupled to opposite sides of the backrest. The armrests each have a wrist support upwardly extending from an upper face of the respective armrest. The wrist supports each have a lower base portion and a spaced apart pair of side portions upwardly extending from the base portion of the respective wrist support.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new arm chair with massaging wrist supports apparatus and method which has many of the advantages of the arm chairs mentioned heretofore and many novel features that result in a new arm chair with massaging wrist supports which is not anticipated, rendered obvious, suggested, or even implied by any of the prior art arm chairs, either alone or in any combination thereof.

It is another object of the present invention to provide a new arm chair with massaging wrist supports which may be easily and efficiently manufactured and marketed.

It is a further object of the present invention to provide a new arm chair with massaging wrist supports which is of a durable and reliable construction.

An even further object of the present invention is to provide a new arm chair with massaging wrist supports which is susceptible of a low cost of manufacture with regard to both materials and labor, and which accordingly is then susceptible of low prices of sale to the consuming public, thereby making such arm chair with massaging wrist supports economically available to the buying public.

Still yet another object of the present invention is to provide a new arm chair with massaging wrist supports which provides in the apparatuses and methods of the prior art some of the advantages thereof, while simultaneously overcoming some of the disadvantages normally associated therewith.

Still another object of the present invention is to provide a new arm chair with massaging wrist supports for supporting and massaging a user's wrists.

Yet another object of the present invention is to provide a new arm chair with massaging wrist supports which includes a seat with a support structure for supporting the seat above a surface and a backrest coupled to the seat. A pair of armrests are coupled to opposite sides of the backrest. The armrests each have a wrist support upwardly extending from an upper face of the respective armrest. The wrist supports each have a lower base portion and a spaced apart pair of side portions upwardly extending from the base portion of the respective wrist support.

Still yet another object of the present invention is to provide a new arm chair with massaging wrist supports that helps reduce fatigue and strain on a user's wrist that could otherwise lead to injuries such as Carpal Tunnel Syndrome.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
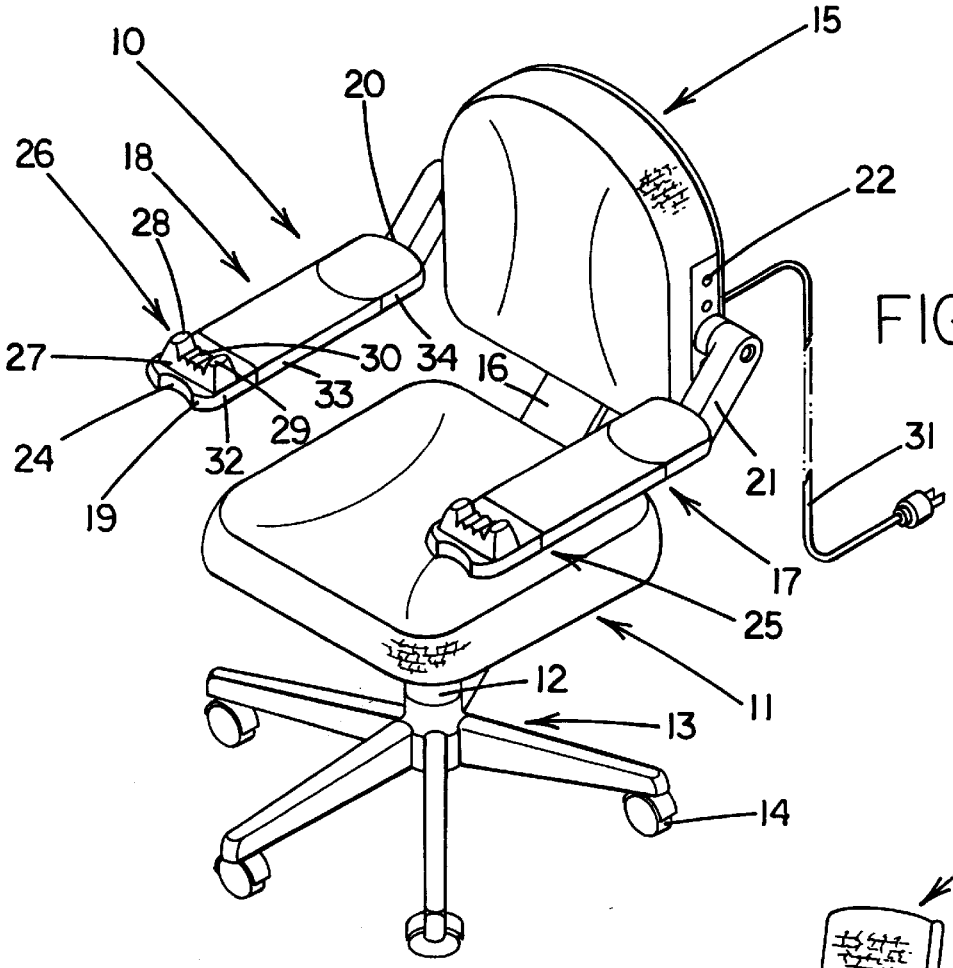
FIG. 1 is a schematic perspective view of a new arm chair with massaging wrist supports according to the present invention.

With reference now to the drawings, and in particular to FIGS. 1 through 4 thereof, a new arm chair with massaging wrist supports embodying the principles and concepts of the present invention and generally designated by the reference numeral 10 will be described.

As best illustrated in FIGS. 1 through 4, the arm chair with massaging wrist supports 10 generally comprises a seat with a support structure for supporting the seat above a surface and a backrest coupled to the seat. A pair of armrests are coupled to opposite sides of the backrest. The armrests each have a wrist support upwardly extending from an upper face of the respective armrest. The wrist supports each have a lower base portion and a spaced apart pair of side portions upwardly extending from the base portion of the respective wrist support.

In closer detail the arm chair 10 comprises a padded seat 11 having a padded top face, a bottom face, a front, a back, and a pair of opposite sides. A telescopically extendable pillar 12 is downwardly depended in a generally vertical direction from the bottom face of the seat. The pillar is swivelably coupled to a base 13 with a plurality of ground engaging caster wheels 14 to permit rotation of pillar about a generally vertical axis on the base. A generally D-shaped padded backrest 15 is coupled to the back of the seat. The backrest has a padded front face, a back face, a generally straight bottom, an arcuate top, and a pair of opposite sides. Preferably, a resiliently deflectable bar 16 couples the backrest to the seat.

Figure 2:
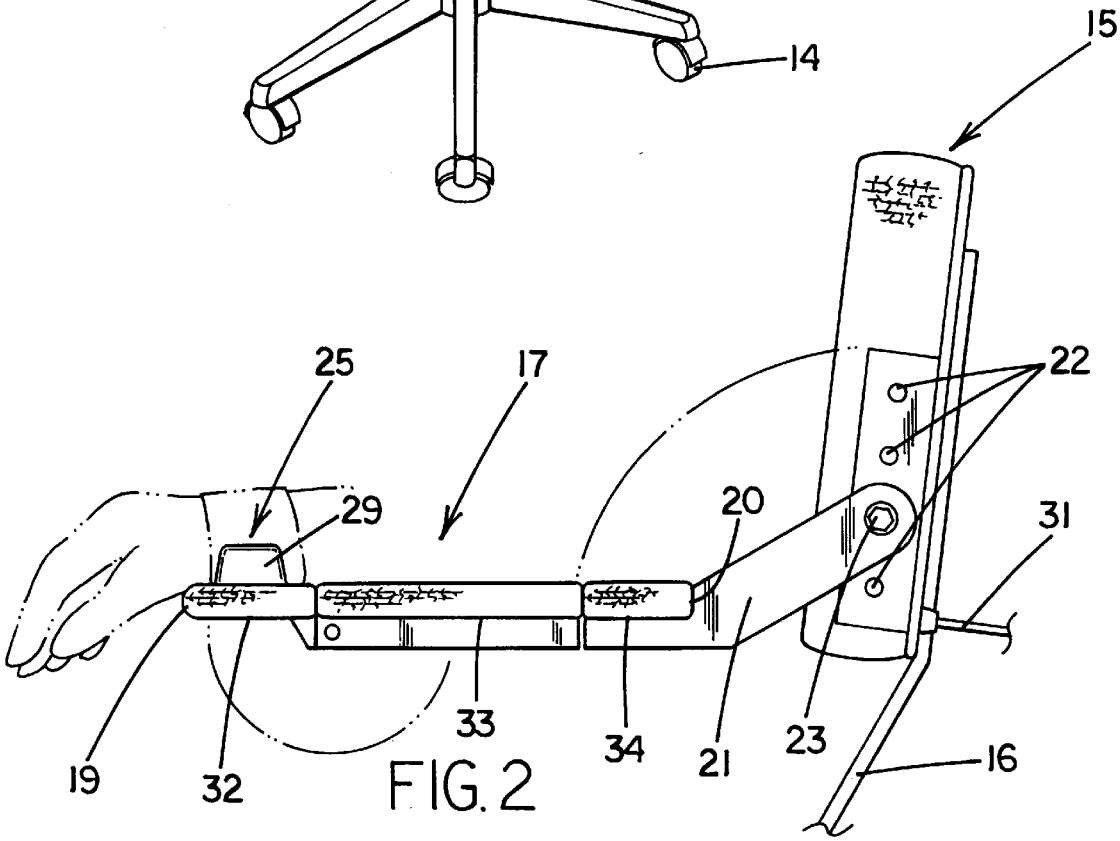
FIG. 2 is a schematic side view of an armrest and backrest of the present invention.
Figure 3:
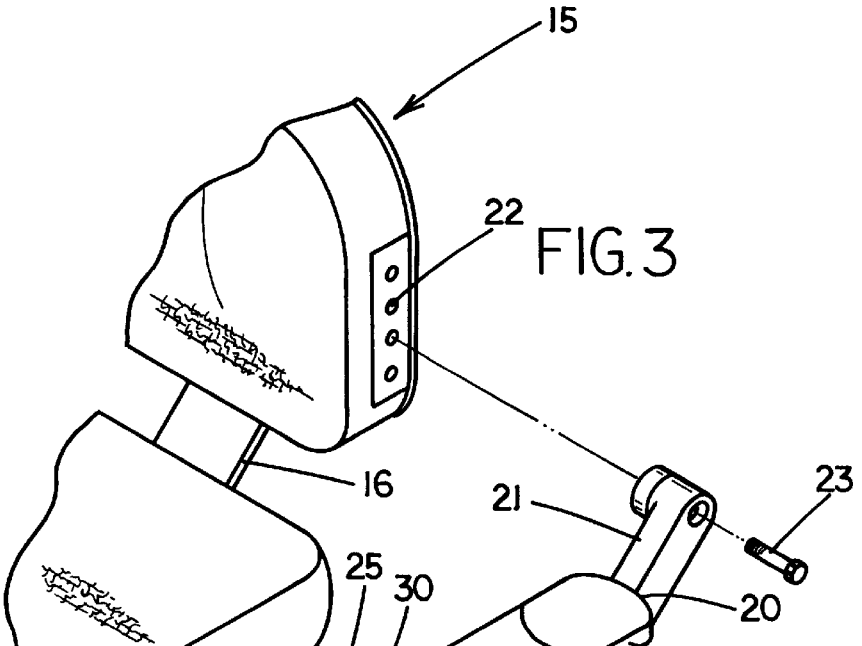
FIG. 3 is a schematic exploded partial perspective view of an armrest and backrest of the present invention.

The chair also has pair of armrests 17,18 each having a padded upper face, a lower face, opposite front and back ends 19,20, and a pair of sides extending between the front and back ends of the respective armrest. Each of the armrests has a mounting arm 21 outwardly and upwardly extending from the back end of the respective armrest. The mounting arm of a first of the armrests is pivotally and detachably coupled to a first of the sides of the backrest to permit pivoting of the first armrest in a generally vertical plane about a generally horizontal axis. Similarly, the mounting arm of a second of the armrests is pivotally and detachably coupled to a second of the sides of the backrest to permit pivoting of the first armrest in a generally vertical plane about a generally horizontal axis. Ideally, each of the sides of the backrest each has a generally vertical row of mounting holes 22. Each of the mounting arms of the armrests has a pivot fastener 23 extended therethrough and inserted into one of the holes of the adjacent associated side of the backrest to pivotally couple each mounting arm to the associated side of the backrest. With reference to FIG. 2, in use, each of the armrests is pivotable with respect to the backrest between a generally horizontal position designed for permitting a user sitting on the seat to rest their arms on the armrest and a generally vertical position designed for making it easier for a user to get out of the chair from a side of the seat.

The front ends of the armrests are forwardly extended from the backrest. The armrests each preferably have a generally U-shaped cutout 24 at the front end of the respective armrest. The cutouts each have a concavity forwardly facing outwards from the respective armrest. The U-shaped cutouts are designed for receiving the wrist of a user's arm resting on the upper face of the respective armrest.

The armrests each have a wrist support 25,26 upwardly extending from the upper face of the respective armrest. The wrist supports are positioned adjacent the front ends of the respective armrest. The wrist supports each have a lower base portion 27 and a spaced apart pair of side portions 28,29 upwardly extending from the base portion of the respective wrist support. The base portion of each wrist support is coupled to the upper face of the respective armrest.

The wrist supports each also have a plurality of massaging fingers 30 upwardly extending from the base portion of the respective wrist support between the side portions of the respective wrist support. The side portions and the massaging fingers each have a height defined in an upwards direction from the associated base portion. Preferably, the height of each side portion is greater than the height of each massaging finger.

In use, the wrist supports are designed for resting the user's wrists thereon as illustrated in FIG. 2 to help reduce strain and fatigue to the user's wrists. The wrist supports each comprises a resiliently deformable material such as a resiliently deformable rubber or plastic for providing additional comfort to a user resting their wrists thereon. Preferably, each of the wrist supports also has a vibrating device therein for vibrating the respective wrist support when activated. Each of the vibrating devices is electrically connectable to an electric power supply by an elongate flexible cord 31 outwardly extending from the backrest.

Each of the armrests has front, middle, and rear portions 32,33,34. The front portion of each armrest is positioned adjacent the front end of the respective armrest. The rear portion of each armrest is positioned adjacent the back end of the respective armrest. The middle portion of each armrest is interposed between the front and rear portions of the respective armrest. Each wrist support is positioned on the front portion of the associated armrest.

The front portions of the armrests each are pivotally coupled to the middle portion of the respective armrest to permit pivoting of each front portion about a generally horizontal axis with respect to the associated middle portion. As illustrated in FIG. 2, each of the front portions is pivotable between a generally horizontal deployed position and a retracted position. The front, middle, and rear portions generally lie in a common plane when the respective front portion is positioned in the deployed position. When the respective front portion is positioned in the retracted position, each front portion is pivoted downwards and positioned beneath the associated middle portion.

Figure 4:
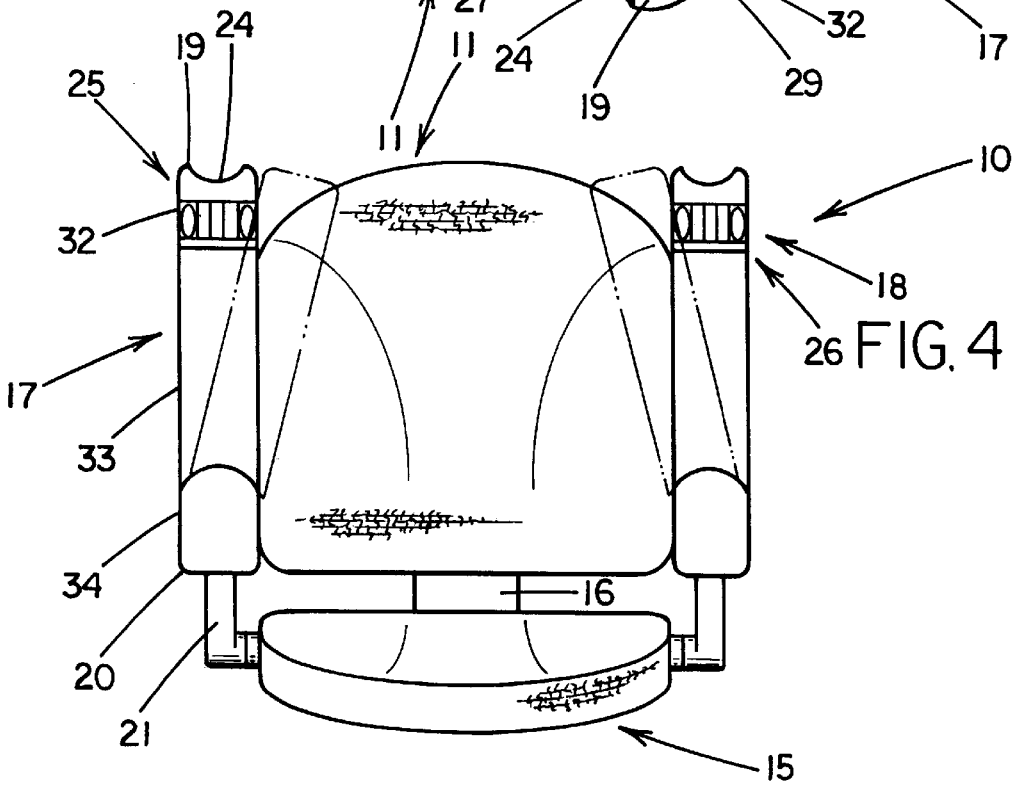
FIG. 4 is a schematic top view of the present invention.

The middle portions of the armrests each are pivotally coupled to the rear portion of the respective armrest to permit pivoting of each middle portion about a generally vertical axis with respect to the associated rear portion. As illustrated in FIG. 4, each of the middle portions is pivotable between a deployed position and a retracted position. The front, middle, and rear portions are generally collinear when the respective middle portion is positioned in the deployed position. Each middle portion is pivoted inwards when the respective middle portion is positioned in the retracted position such that the middle portions are extended at an acute angle to the associated rear portion.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A chair, comprising:

a seat;

a support structure for supporting said seat above a surface;

a backrest being coupled to said seat;

a pair of armrests each having upper and lower faces, opposite front and back ends;

said arm rests being coupled to opposite sides of said backrest;

said armrests each having a wrist support upwardly extending from said upper face of the respective armrest;

said wrist supports each having a lower base portion and a spaced apart pair of side portions upwardly extending from said base portion of the respective wrist support, said base portion of each wrist support being coupled to said upper face of the respective armrest;

wherein each of said armrests has a mounting arm outwardly and upwardly extending from the back end of the respective armrest, said mounting arm of a first of said armrests being pivotally and detachably coupled to a first side of said backrest, said mounting arm of a second of said armrests being pivotally and detachably coupled to a second side of said backrest; and wherein each of said sides of said backrest each have a plurality of mounting holes, each of said mounting arms of said armrests having a pivot fastener extended therethrough and inserted into one of said holes of the adjacent associated side of said backrest to pivotally couple each mounting arm to the associated side of said backrest.

2. The chair of claim 1, wherein said wrist supports each comprise a resiliently deformable material.

3. The chair of claim 1, wherein each of said wrist supports has a vibrating device therein for vibrating the respective wrist support.

4. A chair, comprising:

a seat;

a support structure for supporting said seat above a surface;

a backrest being coupled to said seat;

a pair of armrests each having upper and lower faces, opposite front and back ends;

said arm rests being coupled to opposite sides of said backrest;

said armrests each having a wrist support upwardly extending from said upper face of the respective armrest;

said wrist supports each having a lower base portion and a spaced apart pair of side portions upwardly extending from said base portion of the respective wrist support, said base portion of each wrist support being coupled to said upper face of the respective armrest; and wherein said armrests each have a generally U-shaped cutout at said front end of the respective armrest, said cutouts each having a concavity facing outwards from the respective armrest.

5. The chair of claim 4, wherein said wrist supports each comprise a resiliently deformable material.

6. The chair of claim 4, wherein each of said wrist supports has a vibrating device therein for vibrating the respective wrist support.

7. The chair of claim 4, wherein each of said armrests has a mounting arm outwardly and upwardly extending from the back end of the respective armrest, said mounting arm of a first of said armrests being pivotally and detachably coupled to a first side of said backrest, said mounting arm of a second of said armrests being pivotally and detachably coupled to a second side of said backrest.

8. A chair, comprising:

a seat;

a support structure for supporting said seat above a surface;

a backrest being coupled to said seat;

a pair of armrests each having upper and lower faces, opposite front and back ends;

said arm rests being coupled to opposite sides of said backrest;

said armrests each having a wrist support upwardly extending from said upper face of the respective armrest;

said wrist supports each having a lower base portion and a spaced apart pair of side portions upwardly extending from said base portion of the respective wrist support, said base portion of each wrist support being coupled to said upper face of the respective armrest; and wherein said wrist supports each have a plurality of massaging fingers upwardly extending from said base portion of the respective wrist support between said side portions of the respective wrist support.

9. The chair of claim 8, wherein said side portions and said massaging fingers each have a height defined in an upwards direction from the associated base portion, wherein said height of each side portion is greater than said height of each massaging finger.

10. The chair of claim 8, wherein each of said armrests has a mounting arm outwardly and upwardly extending from the back end of the respective armrest, said mounting arm of a first of said armrests being pivotally and detachably coupled to a first side of said backrest, said mounting arm of a second of said armrests being pivotally and detachably coupled to a second side of said backrest.

11. The chair of claim 8, wherein said wrist supports each comprise a resiliently deformable material.

12. The chair of claim 8, wherein each of said wrist supports has a vibrating device therein for vibrating the respective wrist support.

13. A chair, comprising:

a seat;

a support structure for supporting said seat above a surface;

a backrest being coupled to said seat;

a pair of armrests each having upper and lower faces, opposite front and back ends;

said arm rests being coupled to opposite sides of said backrest;

said armrests each having a wrist support upwardly extending from said upper face of the respective armrest;

said wrist supports each having a lower base portion and a spaced apart pair of side portions upwardly extending from said base portion of the respective wrist support said base portion of each wrist support being coupled to said upper face of the respective armrest; and wherein each of said armrests has front, middle, and rear portions, said front portion of each armrest being positioned adjacent said front end of the respective armrest, said rear portion of each armrest being positioned adjacent said back end of the respective armrest, said middle portion of each armrest being interposed between said front and rear portions of the respective armrest, each of said wrist supports being positioned on said front portion of the associated armrest, said front portions of said armrests each being pivotally coupled to the middle portion of the respective armrest, said middle portions of said armrests each being pivotally coupled to the rear portion of the respective armrest.

14. The chair of claim 13, wherein each of said armrests has a mounting arm outwardly and upwardly extending from the back end of the respective armrest, said mounting arm of a first of said armrests being pivotally and detachably coupled to a first side of said backrest, said mounting arm of a second of said armrests being pivotally and detachably coupled to a second side of said backrest.

15. The chair of claim 13, wherein said wrist supports each comprise a resiliently deformable material.

16. The chair of claim 13, wherein each of said wrist supports has a vibrating device therein for vibrating the respective wrist support.

17. A chair, comprising:

a seat having top and bottom faces, a front, a back, and a pair of opposite sides;

a telescopically extendable pillar being downwardly depended from said bottom face of said seat;

a base having a plurality of ground engaging wheels, said pillar being coupled to said base;

a backrest being coupled to said back of said seat;

said backrest having front, and back faces, a bottom, a top, and a pair of opposite sides;

a pair of armrests each having upper and lower faces, opposite front and back ends, and a pair of sides extending between said front and back ends of the respective armrest;

each of said armrests having a mounting arm outwardly and upwardly extending from the back end of the respective armrest;

said mounting arm of a first of said armrests being pivotally and detachably coupled to a first of said sides of said backrest;

said mounting arm of a second of said armrests being pivotally and detachably coupled to a second of said sides of said backrest;

wherein each of said sides of said backrest each having a plurality of mounting holes, each of said mounting arms of said armrests having a pivot fastener extended therethrough and inserted into one of said holes of the adjacent associated side of said backrest to pivotally couple each mounting arm to the associated side of said backrest;

said front ends of said armrests being forwardly extended from said backrest;

said armrests each having a generally U-shaped cutout at said front end of the respective armrest, said cutouts each having a concavity facing outwards from the respective armrest;

said armrests each having a wrist support upwardly extending from said upper face of the respective armrest, said wrist supports being positioned adjacent said front ends of the respective armrest;

said wrist supports each having a lower base portion and a spaced apart pair of side portions upwardly extending from said base portion of the respective wrist support, said base portion of each wrist support being coupled to said upper face of the respective armrest;

said wrist supports each having a plurality of massaging fingers upwardly extending from said base portion of the respective wrist support between said side portions of the respective wrist support;

said side portions and said massaging fingers each having a height defined in an upwards direction from the associated base portion, wherein said height of each side portion is greater than said height of each massaging finger;

said wrist supports each comprising a resiliently deformable material;

each of said wrist supports having a vibrating device therein for vibrating the respective wrist support;

each of said armrests having front, middle, and rear portions, said front portion of each armrest being positioned adjacent said front end of the respective armrest, said rear portion of each armrest being positioned adjacent said back end of the respective armrest, said middle portion of each armrest being interposed between said front and rear portions of the respective armrest;

each of said wrist supports being positioned on said front portion of the associated armrest;

said front portions of said armrests each being pivotally coupled to the middle portion of the respective armrest to permit pivoting of each front portion about a generally horizontal axis with respect to the associated middle portion; and said middle portions of said armrests each being pivotally coupled to the rear portion of the respective armrest to permit pivoting of each middle portion about a generally vertical axis with respect to the associated rear portion.

* * * * *